United States Patent [19]

Arai

[11] Patent Number: 4,511,909

[45] Date of Patent: Apr. 16, 1985

[54] HEAT-SENSITIVE RECORDING MATERIALS

[75] Inventor: Naoto Arai, Osaka, Japan

[73] Assignee: Kanzaki Paper Mfg. Co., Ltd., Tokyo, Japan

[21] Appl. No.: 437,857

[22] Filed: Oct. 29, 1982

[30] Foreign Application Priority Data

Nov. 17, 1981 [JP] Japan ..... 56-184862

[51] Int. Cl.[3] ..... B41M 5/18

[52] U.S. Cl. ..... 346/208; 346/209; 346/220; 346/221; 427/151

[58] Field of Search ..... 282/27.5; 428/320.8, 428/411, 488, 537, 913, 914, 411.1, 488.1, 537.5; 346/208, 209, 220, 221; 427/151

[56] References Cited

U.S. PATENT DOCUMENTS 4,251,593 2/1981 Sakamoto et al. ..... 428/913

FOREIGN PATENT DOCUMENTS 104908 8/1979 Japan ..... 346/209
55-891 4/1980 Japan ..... 346/209

*Primary Examiner*—Bruce H. Hess
*Attorney, Agent, or Firm*—Finnegan, Henderson, Farabow, Garrett & Dunner

[57] ABSTRACT

A heat-sensitive recording material comprising a support having a recording layer provided thereon, the recording layer comprising a colorless or pale-colored basic dye and a color developing material, wherein the recording layer further comprises at least one heat-fusible material represented by the formula (I) or (II):

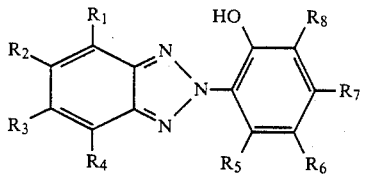

(I)

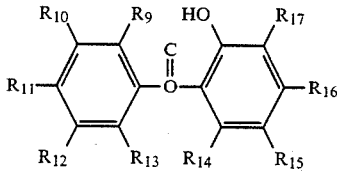

(II)

wherein $R_1$ to $R_{17}$ independently represent a hydrogen atom, a halogen atom, an alkyl group having 1 to 8 carbon atoms, an alkoxy group having 1 to 8 carbon atoms, a phenyl group, a benzyl group, or a benzyloxy group.

4 Claims, No Drawings

HEAT-SENSITIVE RECORDING MATERIALS

FIELD OF THE INVENTION

The present invention relates to heat-sensitive recording materials; and more particularly, to heat-sensitive recording materials that are suitable for use in high-speed recording and which can provide recorded images having excellent stability.

BACKGROUND OF THE INVENTION

Heretofore, heat-sensitive recording materials have been well known, in which colorless or pale-colored basic dyes and organic or inorganic color developing materials are brought into contact with each other by the application of heat to produce recorded images by utilizing the color reaction therebetween as disclosed in, for example, U.S. Pat. No. 3,539,375.

Recent remarkable advances in heat-sensitive recording systems have permitted high-speed operation of various kinds of apparatus utilizing a thermal head, such as heat-sensitive facsimiles and heat-sensitive printers. For example, modern heat-sensitive facsimiles can transmit a printed page of A4 size paper (210×297 mm) in 20 seconds, and modern heat-sensitive printers can print 120 or more letters per second. With the development of such high-speed facsimiles and printers, it is now required for heat-sensitive recording materials which are used in the high-speed facsimiles and printers to have a high recording sensitivity (dynamic recording characteristics). Furthermore, the materials must cause neither static recording within a low temperature range (60° C. to 70° C.) nor piling due to the attachment of tailings.

As the fields in which heat-sensitive recording materials are used expand, they are exposed to a greater chance of direct contact with fingers or contact with plastic films. This results in the recorded image undesirably losing or fading color by sebum of human being or reaction with the plasticizer in the plastics. To avoid such problem, the heat-sensitive recording material must have resistance to fingerprint and plasticizer.

Some conventional high sensitivity heat-sensitive recording materials are prepared using combinations of dyes, phenol compounds such as 4,4'-isopropylidenediphenol, and sensitizers such as stearic acid amide. In a recording layer of such high sensitivity heat-sensitive recording materials, the sensitizer and phenol compound are compounded in a proportion ranging between 2 and 5 per part by weight of the dye. These heat-sensitive recording materials, however, have disadvantages in that the so-called static recording characteristics within a low temperature range (60° C. to 70° C.) occurs as the recording sensitivity is increased, and the resistance to fingerprint and plasticizer is poor.

It has therefore been desired to develop heat-sensitive recording materials which are well-balanced in the quality thereof, i.e., resistance to fingerprint and plasticizer, and are suitable for use in high-speed recording.

SUMMARY OF THE INVENTION

As a result of various investigations to develop heat-sensitive recording materials suitable for use in high-speed recording apparatus, and in particular, extensive studies on a heat-fusible material which is used as an auxiliary agent together with a basic dye and a color developing material, it has been found that the desired effects can be obtained by using a heat-fusible material having a specified structure.

An object of the present invention is, therefore, to provide a heat-sensitive recording material comprising a support having a recording layer provided thereon, the recording layer comprising a colorless or pale-colored basic dye and a color developing material, wherein the recording layer further comprises at least one heat-fusible material represented by the formula (I) or (II):

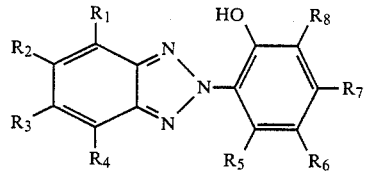

(I)

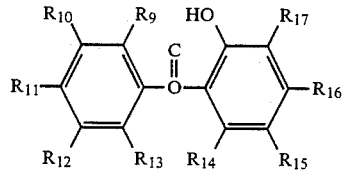

(II)

wherein $R_1$ to $R_{17}$ independently represent a hydrogen atom, a halogen atom, an alkyl group having 1 to 8 carbon atoms, an alkoxy group having 1 to 8 carbon atoms, a phenyl group, a benzyl group, or a benzyloxy group.

DETAILED DESCRIPTION OF THE INVENTION

The exact reason why the heat-sensitive recording material of the present invention containing a specified heat-fusible material in the recording layer thereof is highly suitable for use in high-speed recording and provides a recorded image resistant to fingerprint and plasticizer is not known, but presumably, the adaptivity to high-speed recording is due to the relatively low melting point and good miscibility with dyes of the heat-fusible material.

Colorless or pale-colored basic dyes which can be used in the preparation of the recording layer of the heat-sensitive recording material of the present invention include triarylmethane-based dyes, e.g., 3,3-bis(p-dimethylaminophenyl)-6-dimethylaminophthalide, 3,3-bis(p-dimethylaminophenyl)phthalide, 3-(p-dimethylaminophenyl)-3-(1,2-dimethylindole-3-yl)phthalide, 3-(p-dimethylaminophenyl)-3-(2-methylindole-3-yl)phthalide, 3,3-bis(1,2-dimethylindole-3-yl)-5-dimethylaminophthalide, 3,3-bis(1,2-dimethylindole-3-yl)-6-dimethylaminophthalide, 3,3-bis(9-ethylcarbazole-3-yl)-6-dimethylaminophthalide, 3,3-bis(2-phenylindole-3-yl)-6-dimethylaminophthalide, and 3-p-dimethylaminophenyl-3-(1-methylpyrrole-3-yl)-6-dimethylaminophthalide; diphenylmethane-based dyes, e.g., 4,4'-bis-dimethylaminobenzhydryl-benzylether, N-halophenyl-leucoauramine, and N-2,4,5-trichlorophenyl-leucoauramine; thiazine-based dyes, e.g., benzoyl-leucomethyleneblue, and p-nitrobenzoyl-leucomethyleneblue; spiro-based dyes, e.g., 3-methyl-spiro-dinaphthopyran, 3-ethyl-spiro-dinaphthopyran, 3-phenyl-spiro-dinaphthopyran, 3-benzyl-spiro-dinaphthopyran, 3-methylnaphtho(6'-methoxybenzo)spiropyran, and 3-propyl-spiro-dibenzopyran; lactam-based dyes, e.g., rhodamine-B-anilinolactam, rhodamine(p-nitroanilino)lactam, and rhodamine(o-chloroanilino)-lactam; and fluoran-based dyes, e.g., 3-dimethylamino-7-methoxyfluoran, 3-diethylamino-6-methoxyfluoran, 3-diethylamino-7-methoxyfluoran, 3-diethylamino-7-chlorofluoran, 3-diethylamino-6-methyl-7-chlorofluoran, 3-diethylamino-6,7-dimethylfluoran, 3-(N-ethyl-p-toluidino)-7-methylfluoran, 3-diethylamino-7-(N-acetyl-N-methylamino)fluoran, 3-diethylamino-7-methylaminofluoran, 3-diethylamino-7-dibenzylaminofluoran, 3-diethylamino-7-(N-methyl-N-benzylamino)-fluoran, 3-diethylamino-7-(N-chloroethyl-N-methylamino)fluoran, 3-diethylamino-7-diethylaminofluoran, 3-(N-ethyl-p-toluidino)-6-methyl-7-phenylaminofluoran, 3-(N-ethyl-p-toluidino)-6-methyl-7-(p-toluidino)fluoran, 3-diethylamino-6-methyl-7-phenylaminofluoran, 3-diethylamino-7-(2-carbomethoxyphenylamino)fluoran, 3-(N-cyclohexyl-N-methylamino)-6-methyl-7-phenylaminofluoran, 3-pyrrolidino-6-methyl-7-phenylaminofluoran, 3-piperidino-6-methyl-7-phenylaminofluoran, 3-diethylamino-6-methyl-7-xylidinofluoran, 3-diethylamino-7-(o-chlorophenylamino)fluoran, 3-dibutylamino-7-(o-chlorophenylamino)fluoran, and 3-pyrrolidino-6-methyl-7-p-butylphenylaminofluoran. The present invention is not limited to these exemplified basic dyes. These basic dyes can be used either alone or in admixture.

Many compounds are known as the color developing material that, when heated, contacts the colorless or pale-colored basic dye to generate a color, e.g., inorganic acidic materials including activated clay, acidic clay, attapulgite, bentonite, colloidal silica and aluminum silicate; and organic acidic materials including phenolic compounds such as 4-tert-butylphenol, 4-tert-octylphenol, 4-phenylphenol, 4-acetylphenol, α-naphthol, β-naphthol, hydroquinone, 2,2'-dihydroxydiphenyl, 2,2'-methylenebis(4-methyl-6-tert-butylphenol), 2,2'-methylenebis(4-chlorophenol),4,4'-dihydroxydiphenylmethane, 4,4'-isopropylidenediphenol (bisphenol A), 4,4'-isopropylidenebis(2-tert-buthylphenol), 4,4'-sec-butylidenephenol, 4,4'-cyclohexylidenediphenol, 4,4'-dihydroxydiphenyl sulfide, 4,4,'-thiobis(6-tert-butyl-3-methylphenol), 4,4'-dihydroxydiphenyl sulfone, 4-hydroxybenzoic acid benzylester, hydroquinone monobenzyl ether, novolak phenol resins and phenolic polymers; aromatic carboxylic acids such as benzoic acid, p-tert-butylbenzoic acid, trichlorobenzoic acid, 3-sec-butyl-4-hydroxybenzoic acid, 3-cyclohexyl-4-hydroxybenzoic acid, 3,5-dimethyl-4-hydroxybenzoic acid, salicylic acid, 3-isopropylsalicylic acid, 3-tert-butylsalicylic acid, 3-benzylsalicylic acid, 3-(α-methylbenzyl)salicylic acid, 3-chloro-5-(α-methylbenzyl)salicylic acid, 3,5-di-tert-butylsalicylic acid, 3-phenyl-5-(α,α-dimethylbenzyl)salicylic acid, 3,5-di-(α-methylbenzyl)salicylic acid, and terephthalic acid; also, salts of such phenolic compounds or aromatic carboxylic acids with polyvalent metals such as zinc, magnesium, aluminum, calcium, titanium, manganese, tin and nickel.

As described above, the heat-sensitive recording material of the present invention contains at least one heat-fusible material as specified by the formula (I) or (II) in the recording layer thereof. It is desired to suitably select the heat-fusible material by taking into account the miscibility and melting point thereof depending upon the basic dye and color developing material. Further, in order to satisfy the object of the present invention and an effect for controlling the static recording characteristics, those heat-fusible materials having a melting point of at least 80° C. are preferably used.

In addition, of the heat-fusible materials represented by the formula (I) or (II), those represented by the following formula (I') or (II') are suitable:

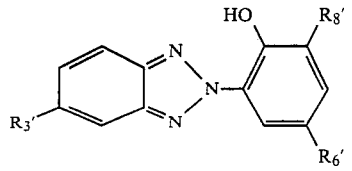

(I')

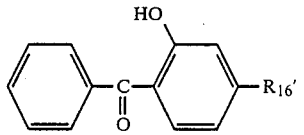

(II')

wherein $R_3'$ represents a hydrogen atom or a halogen atom; $R_6'$ and $R_8'$ independently represent a hydrogen atom or an alkyl group having 1 to 8 carbon atoms; and $R_{16}'$ represents an alkoxy group having 1 to 8 carbon atoms or a benzyloxy group.

Typical examples of the heat-fusible materials which can be used in the present invention are listed below:

| | |
|---|---|
| 2-(2'-Hydroxy-5'-methylphenyl)benzotriazole | m.p. 130° C. |
| 2-(2'-Hydroxy-3',5'-di-tert-butylphenyl)-5-chlorobenzotriazole | m.p. 156° C. |
| 2-(2'-Hydroxy-3'-tert-butyl-5'-methylphenyl)-5-chlorobenzotriazole | m.p. 140° C. |
| 2-(2'-Hydroxy-3',5'-di-tert-amylphenyl)-benzotriazole | m.p. 80° C. |
| 2-(2'-Hydroxy-3',5'-di-tert-butylphenyl)-benzotriazole | m.p. 154° C. |
| 2-(2'-Hydroxy-5'-tert-butylphenyl)benzotriazole | m.p. 98° C. |
| 2-(2'-Hydroxy-5'-tert-octylphenyl)benzotriazole | m.p. 105° C. |
| 2-Hydroxy-4-benzyloxybenzophenone | m.p. 115° C. |
| 2-Hydroxy-4-methoxybenzophenone | m.p. 64° C. |
| 2-Hydroxy-4-n-octoxybenzophenone | m.p. 48° C. |

Of these heat-fusible materials, 2-(2'-hydroxy-5'-methylphenyl)benzotriazole is most preferably used because not only it is excellent in the adaptivity to high-speed recording and resistance to fingerprint and plasticizer, but also it is quite excellent in the effect for controlling the static recording, especially when used together with 4,4'-isopropylidenediphenol as the color developing material, it exhibits an effect such that it does not generate a color even at 80° C.

In the present invention, the desired effects can be obtained by using at least 10 parts by weight of the heat-fusible material based on 100 parts by weight of the color developing material. If the amount of the heat-fusible material is below 10 parts by weight, improved effects in the resistance to fingerprint and plasticizer cannot be obtained. Accordingly, good results can be obtained using 10 to 1,000 parts by weight, preferably 50 to 500 parts by weight, of the heat-fusible material based on 100 parts by weight of the color developing material. The proportion of the color developing material to the basic dye is not particularly restricted, but 100 to 1,000 parts by weight, preferably 100 to 500 parts by weight, of the color developing material is used based on 100 parts by weight of the basic dye.

Water is generally used as a dispersion medium for preparing a heat-sensitive coating composition used for the formation of the recording layer of the present invention. The basic dye and color developing material of the present invention are in general separately dispersed in water by the use of an agitator or pulverizer such as a ball mill, attritor or sand mill, and the two dispersions are mixed into a coating composition which is then applied to a support. The heat-fusible material may be first dispersed in water and then mixed with the dispersions of the basic dye and color developing material. Alternatively, the heat-fusible material may be dispersed in water together with the basic dye or color developing material.

The coating composition usually contains a binder. Examples of such binders include starch, oxidized starch, esterified starch, etherified starch, other modified starches, hydroxyethyl cellulose, methyl cellulose, carboxymethyl cellulose, gelatin, casein, gum arabic, polyvinyl alcohol, styrene-maleic anhydride copolymer salts, styrene-acrylic acid copolymer salts, and styrene-butadiene copolymer emulsions. The amount of the binder used is generally 10 to 40% by weight, preferably 15 to 30% by weight, based on the weight of the total solids.

The coating composition may further contain various auxiliary agents. Examples of such auxiliary agents are dispersants such as sodium dioctylsulfosuccinate, sodium dodecylbenzenesulfonate, sodium lauryl sulfate and fatty acid metal salts; defoaming agents; fluorescent dyes; and coloring dyes.

Furthermore, in order that the heat-sensitive recording material does not produce sticking upon coming into contact with a recording head, dispersions or emulsions of stearic acid, polyethylene, carnauba wax, paraffin wax, zinc stearate, calcium stearate, and ester wax can be added to the coating composition. In order to reduce the attachment of tailings to a recording head, inorganic pigments such as kaolin, clay, talc, calcium carbonate, calcined clay, titanium oxide, activated clay, and oil-absorptive pigments (e.g., kieselguhr and fine granular anhydrous silica) can be added to the coating composition.

Supports used in the preparation of the heat-sensitive recording material of the present invention include paper, plastic films and synthetic paper. The use of paper is the most preferred in view of cost and ease of coating. The paper may be neutral paper (e.g., paper made by use of a neutral sizing agent), or paper coated with a pigment such as calcium carbonate, amorphous silicon oxide, or calcined clay.

Although the amount of the coating composition to be coated on the support to prepare a recording layer is not critical, it is usually from 2 to 12 g/m$^2$, preferably from 3 to 10 g/m$^2$, on a dry weight basis. If a smooth surface is particularly needed, the recording layer formed may be smoothed by supercalendering or machine calendering.

The present invention is now described in greater detail by reference to the following Examples and Comparative Example which are given here for illustrative purposes only and are by no means intended to limit its scope. All parts and percentages are by weight.

EXAMPLE 1

| Preparation of Solution A | parts |
|---|---|
| 3-(N—Cyclohexyl-N—methylamino)-6-methyl-7-phenylaminofluoran | 10 |
| 5% Aqueous solution of methyl cellulose | 5 |

-continued

| Preparation of Solution A | parts |
|---|---|
| Water | 40 |

A composition made of the above ingredients was pulverized by means of a sand mill to an average particle size measured by a Coulter Counter (MODEL-TA, made by Coulter Electronics Inc.) of 3 μm. (This pulverization method is common in all of the Examples and Comparative Example.)

| Preparation of Solution B | parts |
|---|---|
| 4,4'-Isopropylidenediphenol | 20 |
| 5% Aqueous solution of methyl cellulose | 5 |
| Water | 55 |

A composition made of the above ingredients was pulverized to an average particle size of 3 μm.

| Preparation of Solution C | parts |
|---|---|
| 2-(2'-Hydroxy-5'-methylphenyl)benzotriazole | 20 |
| 5% Aqueous solution of methyl cellulose | 5 |
| Water | 55 |

A composition made of the above ingredients was pulverized to an average particle size of 3 μm.

FORMATION OF RECORDNG LAYER

A mixture of 55 parts of Solution A, 80 parts of Solution B, 80 parts of Solution C, 15 parts of fine granular anhydrous silica [oil absorption (measured according to JIS K5101): 180 ml/100 g], 50 parts of a 20% aqueous solution of oxidized starch and 10 parts of water was stirred to prepare a coating composition. The coating composition was applied to a base paper of 50 g/m$^2$ in a dry weight of 7 g/m$^2$, and dried to prepare a sample of heat-sensitive recording paper.

EXAMPLES 2 TO 9

Eight samples of heat-sensitive recording paper were prepared by repeating the same procedure as in Example 1 except that in the preparation of Solution C, 2-(2'-hydroxy-5'-methylphenyl)benzotriazole was replaced by 2-(2'-hydroxy-3',5'-di-tert-butylphenyl)-5-chlorobenzotriazole (Example 2), 2-(2'-hydroxy-3'-tert-butyl-5'-methylphenyl)-5-chlorobenzotriazole (Example 3), 2-(2'-hydroxy-3',5'-di-tert-amylphenyl)benzotriazole (Example 4), 2-(2'-hydroxy-3',5'-di-tert-butylphenyl)benzotriazole (Example 5), 2-(2'-hydroxy-5'-tert-butylphenyl)benzotriazole (Example 6), 2-(2'-hydroxy-5'-tert-octylphenyl)benzotriazole (Example 7), 2-hydroxy-4-benzyloxybenzophenone (Example 8), and 2-hydroxy-4-methoxybenzophenone (Example 9), respectively.

EXAMPLE 10

A sample of heat-sensitive recording paper was prepared by repeating the same procedure as in Example 1 except that 20 parts of 2-(2'-hydroxy-5'-methylphenyl)-benzotriazole was replaced by a mixture of 10 parts of 2-(2'-hydroxy-5'-methylphenyl)benzotriazole and 10 parts of 2-hydroxy-4-benzyloxybenzophenone in the preparation of Solution C.

EXAMPLES 11 TO 13

Three samples of heat-sensitive recording paper were prepared by repeating the same procedure as in Example 1 except that in the preparation of Solution B, 4,4'-isopropylidenediphenol was replaced by hydroquinone monobenzyl ether (Example 11), 4-hydroxybenzoic acid benzyl ester (Example 12), and 4,4'-thiobis(6-tert-butyl-3-methylphenol) (Example 13), respectively.

COMPARATIVE EXAMPLE

A sample of heat-sensitive recording paper was prepared by repeating the same procedure as in Example 1 except that 2-(2'-hydroxy-5'-methylphenyl)benzotriazole was replaced by stearic acid amide in the preparation of Solution C.

Using the 14 samples of heat-sensitive recording paper prepared in Examples 1 to 13 and Comparative Example, recording was conducted with a heat-sensitive facsimile apparatus (HIFAX 700 of Hitachi, Ltd.). The data on the recording sensitivity, static recording property and resistance to fingerprint and plasticizer of the image produced by the respective samples is given in the following table.

| | (*1) Recording Sensitivity | (*2) Static Recording Property | (*3) Resistance to Fingerprint | (*4) Resistance to Plasticizer |
|---|---|---|---|---|
| Example 1 | 1.21 | 0.20 | | |
| Example 2 | 1.16 | 0.33 | | |
| Example 3 | 1.20 | 0.35 | | |
| Example 4 | 1.24 | 0.68 | | |
| Example 5 | 1.18 | 0.32 | | |
| Example 6 | 1.22 | 0.63 | | |
| Example 7 | 1.14 | 0.56 | | |
| Example 8 | 1.09 | 0.27 | | |
| Example 9 | 1.06 | 0.77 | | |
| Example 10 | 1.17 | 0.38 | | |
| Example 11 | 1.25 | 0.61 | | |
| Example 12 | 1.29 | 0.64 | | |
| Example 13 | 1.20 | 0.32 | | |
| Comparative Example | 0.97 | 0.89 | X | X |

Criteria for evaluation of resistance to fingerprint and plasticizer of the recorded image:

: The color density did not substantially decrease, and the image did not at all lose.

: The color density decreased, but the image did not lose, which results in no problem in practical use.

X: The color density greatly decreased, and the image partially lost to an extent that one cannot decipher it.

(*1) The recording sensitivity is expressed by the color density of the recorded image, as measured with a Macbeth reflection densitometer (Model RD-100R; and amber filter was used), immediately after the recording on the facsimile apparatus. The higher the value, the better the property.

(*2) The static recording property is expressed by the color density of the recorded image, as measured the same Macbeth reflection densitometer as above, after contacting the recorded paper with a hot plate held at 80° C. at a contacting pressure of 10 g/cm$^2$ for 5 seconds. The smaller the value, the better the property.

(*3) The recorded paper was fingerprinted and one week later, the recorded image was checked for any loss.

(*4) The recorded paper was brought into contact with a polyvinyl chloride film in such a manner that the recording layer was faced at the polyvinyl chloride film and 24 hours later, the recorded image was checked for any loss.

It is clear from the results shown in the above table that the heat-sensitive recording papers obtained in the Examples of the present invention provided a recorded image having a good balance in recording sensitivity, static recording property and resistance to fingerprint and plasticizer.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording material comprising a support having a recording layer provided thereon, said recording layer comprising (a) a colorless or pale-colored basic dye selected from the group consisting of 3-(N-ethyl-p-toluidino)-6-methyl-7-phenylaminofluoran, 3-(N-ethyl-p-toluidino)-6-methyl-7-(p-toluidino)-fluoran, 3-diethylamino-6-methyl-7-phenylaminofluoran, 3-diethylamino-7-(2-carbomethoxyphenylamino)-fluoran, 3-(N-cyclohexyl-N-methylamino)-6-methyl-7-phenylaminofluoran, 3-pyrrolidino-6-methyl-7-phenylaminofluoran, 3-piperidino-6-methyl-7-phenylaminofluoran, 3-diethylamino-6-methyl-7-xylidinofluoran, 3-pyrrolidino-6-methyl-7-p-butylphenylaminofluoran, and 3,3-bis-(p-dimethylaminophenyl)-6-dimethylaminophthalide, (b) a color developing material, and (c) at least one heat-fusible material represented by the formula (I):

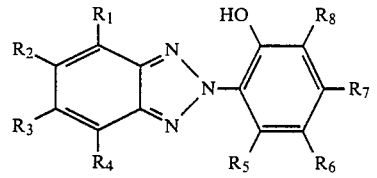

(I)

wherein $R_1$ to $R_8$ independently represent a hydrogen atom, a halogen atom, an alkyl group having 1 to 8 carbon atoms, an alkoxy group having 1 to 8 carbon atoms, a phenyl group, a benzyl group, or a benzyloxy group, and wherein the ratio by weight of said at least one heat-fusible material to said developing material is at least 1 to 10.

2. A heat-sensitive recording material as claimed in claim 1, wherein said at least one heat-fusible material is represented by the formula (I'):

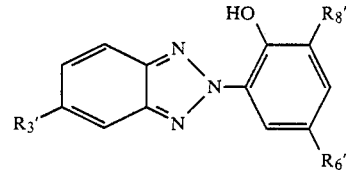

(I')

wherein $R_3'$ represents a hydrogen atom or a halogen atom; and $R_6'$ and $R_8'$ independently represent a hydrogen atom or an alkyl group having 1 to 8 carbon atoms.

3. A heat-sensitive recording material as claimed in claim 1, wherein said heat-fusible material has a melting point of at least 80° C.

4. A heat-sensitive recording material comprising a support having a recording layer provided thereon, said recording layer comprising (a) a colorless or pale-colored basic dye other than 3-diethylamino-7-(o-chlorophenylamino)fluoran and 3-dibutylamino-7-(o-chlorophenylamino)fluoran, (b) a color developing material, and (c) at least one heat-fusible material represented by the formula (I):

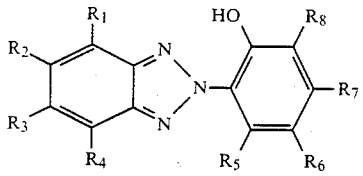

(I)

wherein $R_1$ to $R_8$ independently represent a hydrogen atom, a halogen atom, an alkyl group having 1 to 8 carbon atoms, an alkoxy group having 1 to 8 carbon atoms, a phenyl group, a benzyl group, or a benzyloxy group, and wherein the ratio by weight of said at least one heat-fusible material to said developing material is at least 1 to 10.

* * * * *

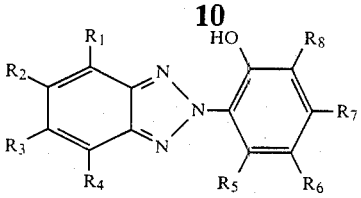

(I)

wherein $R_1$ to $R_8$ independently represent a hydrogen atom, a halogen atom, an alkyl group having 1 to 8 carbon atoms, an alkoxy group having 1 to 8 carbon atoms, a phenyl group, a benzyl group, or a benzyloxy group, and wherein the ratio by weight of said at least one heat-fusible material to said developing material is at least 1 to 10.

* * * * *